US006969811B1

(12) United States Patent
Lai

(10) Patent No.: US 6,969,811 B1
(45) Date of Patent: Nov. 29, 2005

(54) FOOT SWITCH STRUCTURE OF EXTENSION CORD RECEPTACLE

(76) Inventor: Li-Chun Lai, 21F-1, No. 33, Sec. 1, Minsheng Rd., Panciao City, Taipei County (TW)

( * ) Notice: Subject to any disclaimer, the term of this patent is extended or adjusted under 35 U.S.C. 154(b) by 0 days.

(21) Appl. No.: 10/929,495

(22) Filed: Aug. 31, 2004

(51) Int. Cl.[7] ..... H01H 3/14
(52) U.S. Cl. ..... 200/86.5; 200/61.85
(58) Field of Search ..... 200/86.5, 283, 200/61.85, 284, 564–572; 307/120–124

(56) References Cited

U.S. PATENT DOCUMENTS 2,744,176 A * 5/1956 Kaman ..... 173/171
3,867,591 A * 2/1975 Nordeen ..... 200/52 R
4,082,666 A * 4/1978 Jones et al. ..... 210/93
4,439,650 A * 3/1984 Brown ..... 200/61.89
4,488,017 A * 12/1984 Lee ..... 463/38
4,496,811 A * 1/1985 Irwin ..... 200/86.5
4,580,403 A * 4/1986 Hummel ..... 62/171
4,751,354 A * 6/1988 Walthall ..... 200/322
4,853,821 A * 8/1989 Lewis ..... 361/92
4,879,438 A * 11/1989 Winchester ..... 200/61.85
4,894,652 A * 1/1990 Eckstein et al. ..... 340/467
5,045,833 A * 9/1991 Smith ..... 340/332
5,132,498 A * 7/1992 Lee ..... 200/523
5,151,844 A * 9/1992 Lin ..... 361/179
5,666,453 A * 9/1997 Dannenmann ..... 385/101
5,844,763 A * 12/1998 Grace et al. ..... 361/111
5,970,212 A * 10/1999 Freidel ..... 392/405
6,051,801 A * 4/2000 Wang ..... 200/571
6,360,630 B2 * 3/2002 Holtorf ..... 74/512
6,362,441 B1 * 3/2002 Xie ..... 200/86.5
6,476,728 B1 * 11/2002 Sakakibara ..... 340/870.02
6,750,410 B2 * 6/2004 Lee ..... 200/51.03
6,866,507 B2 * 3/2005 Beerstecher ..... 433/101
6,878,889 B1 * 4/2005 Horst et al. ..... 200/51.11
6,894,236 B2 * 5/2005 Chappuis ..... 200/86.5

* cited by examiner

*Primary Examiner*—Anh T. Mai
*Assistant Examiner*—Lisa Klaus

(57) ABSTRACT

An improved foot switch structure of an extension cord receptacle comprises a base. The base has thereon a control switch, wherein the control switch is connected to a power conducting wire. The power conducting wire has one end connected to a power plug and the other end connected to a power receptacle. The control switch is located between the power plug and the power receptacle for controlling whether power is conducted to the power receptacle. The base has an electrically conductive plate fixed on an edge thereof. The electrically conductive plate has a tapering portion, which is inserted into the power conducting wire such that power is conducted to the electrically conductive plate. In addition, two power indicator lamps are provided on the electrically conductive plate. These two power indicator lamps are disposed on opposite sides of the control switch, wherein one power indicator lamp continuously emits light, and the other power indicator lamp is controlled by the control switch and covered with a top cover. The top cover has embedded therein a button. The location of the button corresponds to the control button. When a user presses down the button by stepping on the top cover, the control switch is in the ON state such that the other power indicator lamp emits light and power is conducted to the power receptacle.

6 Claims, 5 Drawing Sheets

FOOT SWITCH STRUCTURE OF EXTENSION CORD RECEPTACLE

BACKGROUND OF THE INVENTION

1. Field of the Invention

This invention relates to an improved foot switch structure of an extension cord receptacle, and in particular, to an improved foot switch structure of an extension cord receptacle having two power indicator lamps in the switch, wherein one power indicator lamp emits light continuously, and the other power indicator lamp emits light when the control switch is in the ON state.

2. Description of the Prior Art

Extension cord receptacles are widely used to properly solve the problem of lacking power receptacles in regular homes or workplaces when the receptacles to be used for electric appliances, bulbs hung on the trees outdoors or the outdoor works are insufficient. Therefore, extension cord receptacles become essential articles for daily use. In order to increase the use safety, one kind of extension cord receptacle provided thereon with a power switch is introduced to the market. When such extension cord receptacle is not in use, the supplied power is interrupted via the power switch so as to prevent the risk of electric shock due to an erroneous contact with the receptacle.

Although the extra power switch can improve the use safety of the extension cord receptacle, it still has some drawbacks. For example, since the power switch is a change over switch, the user should bend down to change the ON/OFF state of the change over switch by hand when the user needs to conduct or interrupt the power. Because no protective measure is taken, the hand of the user may readily incur electric shock when the change over switch is changed by hand.

Accordingly, the above-described prior art product is not a perfect design and has still many disadvantages to be solved.

In views of the above-described disadvantages resulted from the conventional product, the applicant keeps on carving unflaggingly to develop an improved foot switch structure of an extension cord receptacle according to the present invention through wholehearted experience and research.

SUMMARY OF THE INVENTION

An object of the invention is to provide an improved foot switch structure of an extension cord receptacle having two power indicator lamps in the switch, wherein one power indicator lamp emits light continuously to indicate whether no power is supplied to the power receptacle and the position of the switch and act as a night lamp when used in a dark place; and the power receptacle is in ON state when both indicator lamps simultaneously emit light.

Another object of the invention is to provide an improved foot switch structure of an extension cord receptacle, wherein a foot switch is provided on the extension cord receptacle such that the user can conduct or interrupt power by stepping on the foot switch or exerting force by foot so as to achieve safety.

The above objects of the present invention can be achieved by using an improved foot switch structure of an extension cord receptacle. The improved foot switch structure of an extension cord receptacle comprises a base, an electrically conductive plate, a control switch, a top cover, a button cover, an extension cord receptacle and two power indicator lamps. The control switch is provided on the center of the base, and has two bilateral connecting terminals. The extension cord receptacle comprises a power conducting wire. The power conducting wire comprises a ground wire and an electricity conducting wire. One end of the power conducting wire is connected to a power plug, and the other end thereof is connected to a power receptacle. One conducting wire of the power conducting wire is bisected, and the both bisectors are connected to the two bilateral connecting terminals of the control switch, respectively. Thus, the control switch can control whether the power is supplied to the power receptacle. The electrically conductive plate has a tapering portion, which is placed on an edge of the base and inserted into the other conducting wire of the power conducting wire such that power is conducted to the electrically conductive plate. In addition, these two power indicator lamps are electrically connected to the electrically conductive plate and the control switch such that these two power indicator lamps are disposed on opposite sides of the control switch. The button cover is embedded in the center of the top cover. The base is covered with the top cover such that the central button of the top cover corresponds to the control button of the control switch. When the power plug of the extension cord receptacle is plugged in the wall socket, power can be introduced to the control switch such that one power indicator lamp at one side of the control switch continuously emits light. Whereas, when a user steps on the button cover of the top cover, the control switch is in the ON state such that the other power indicator lamp emits light simultaneously. Therefore, it is realized that power is conducted to the power receptacle of the extension cord receptacle.

These features and advantages of the present invention will be fully understood and appreciated from the following detailed description of the accompanying Drawings.

DETAILED DESCRIPTION OF THE PREFERRED EMBODIMENT

Figure 1:
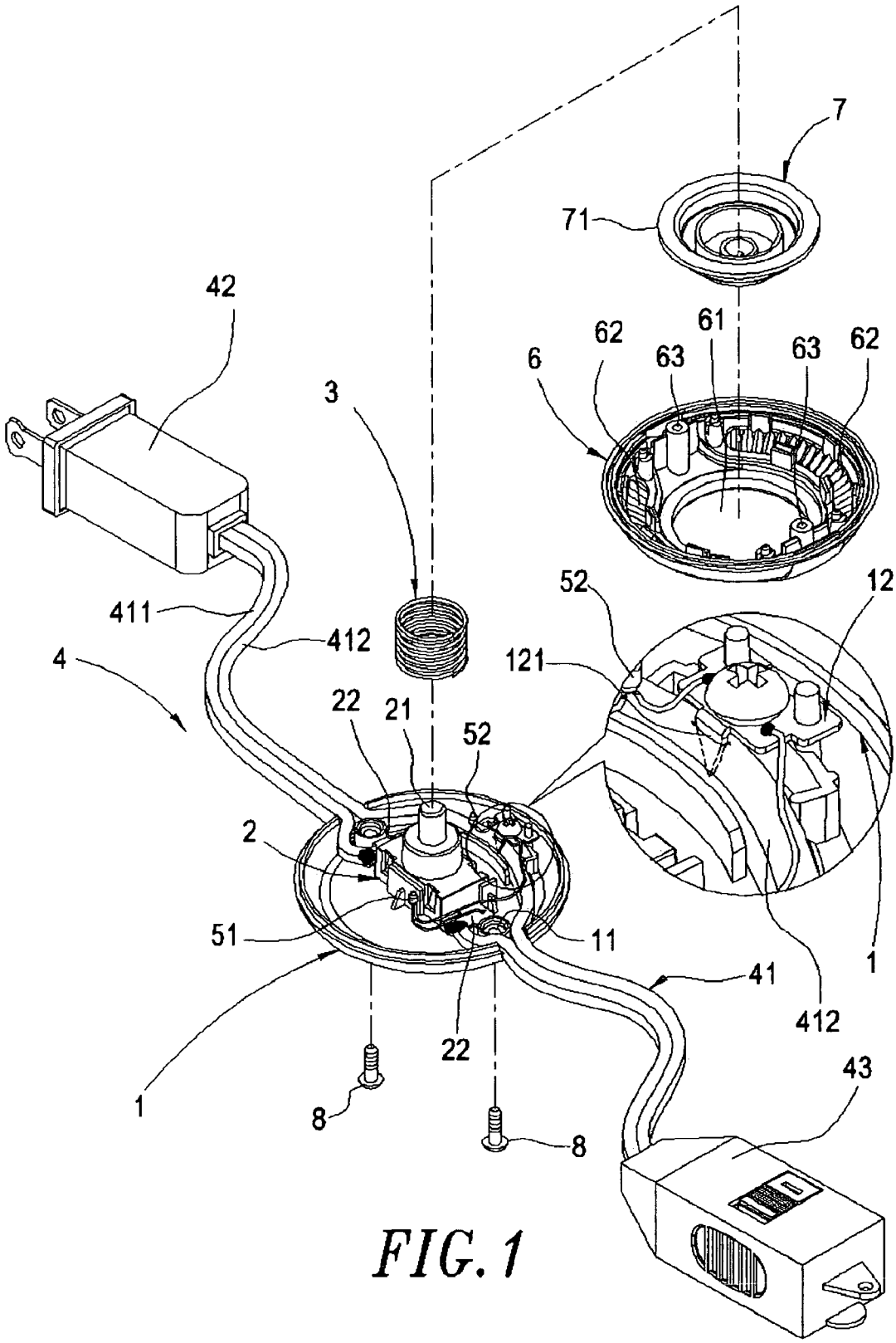
FIG. 1 is a schematic exploded view illustrating an improved foot switch structure of an extension cord receptacle according to the present invention.
Figure 2:
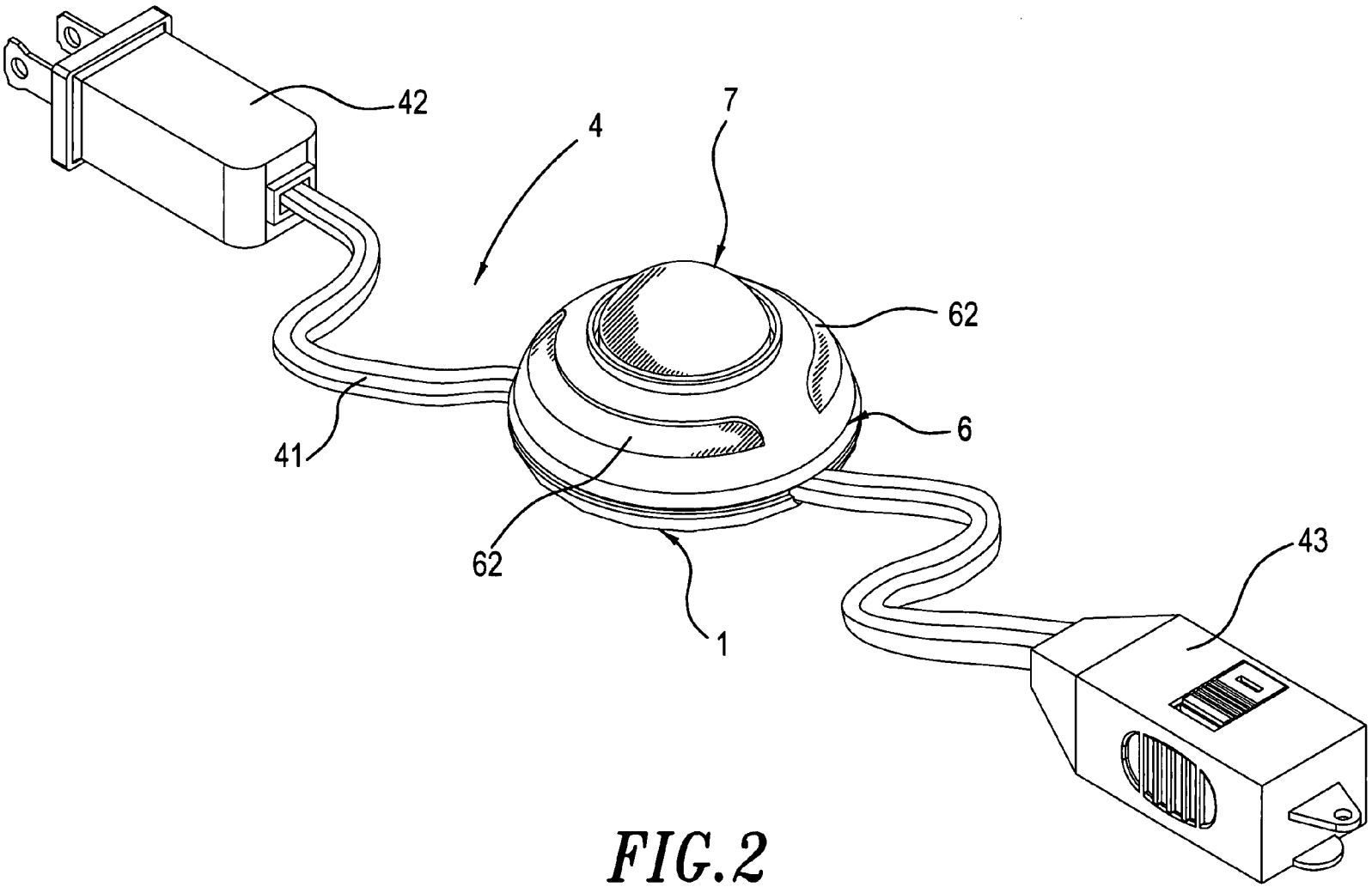
FIG. 2 is a schematic perspective view illustrating the improved foot switch structure of an extension cord receptacle according to the present invention.
Figure 3A:
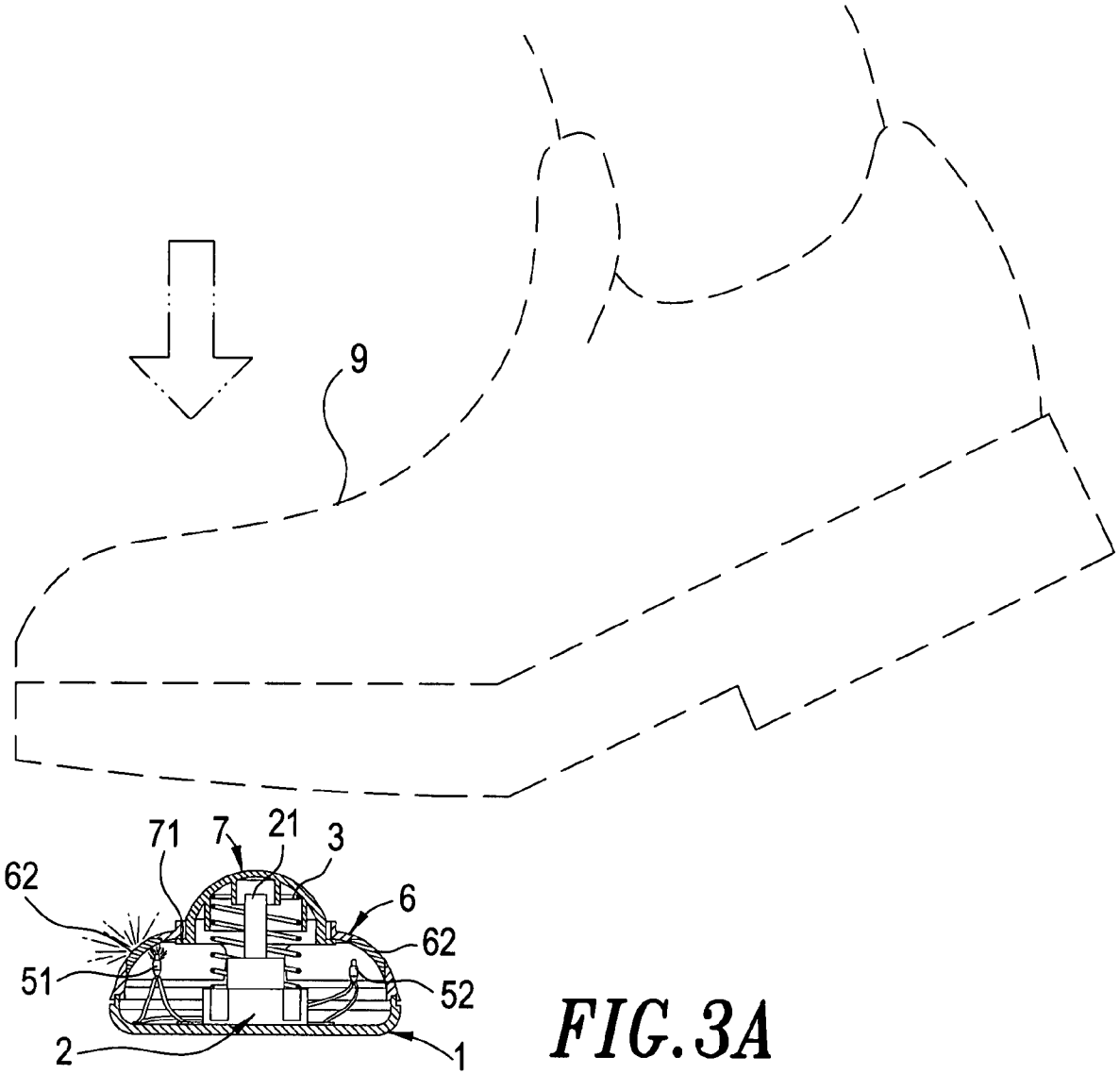
FIGS. 3A, 3B and 3C are schematic views illustrating the actions of the improved foot switch structure of an extension cord receptacle according to the present invention.
Figure 3B:
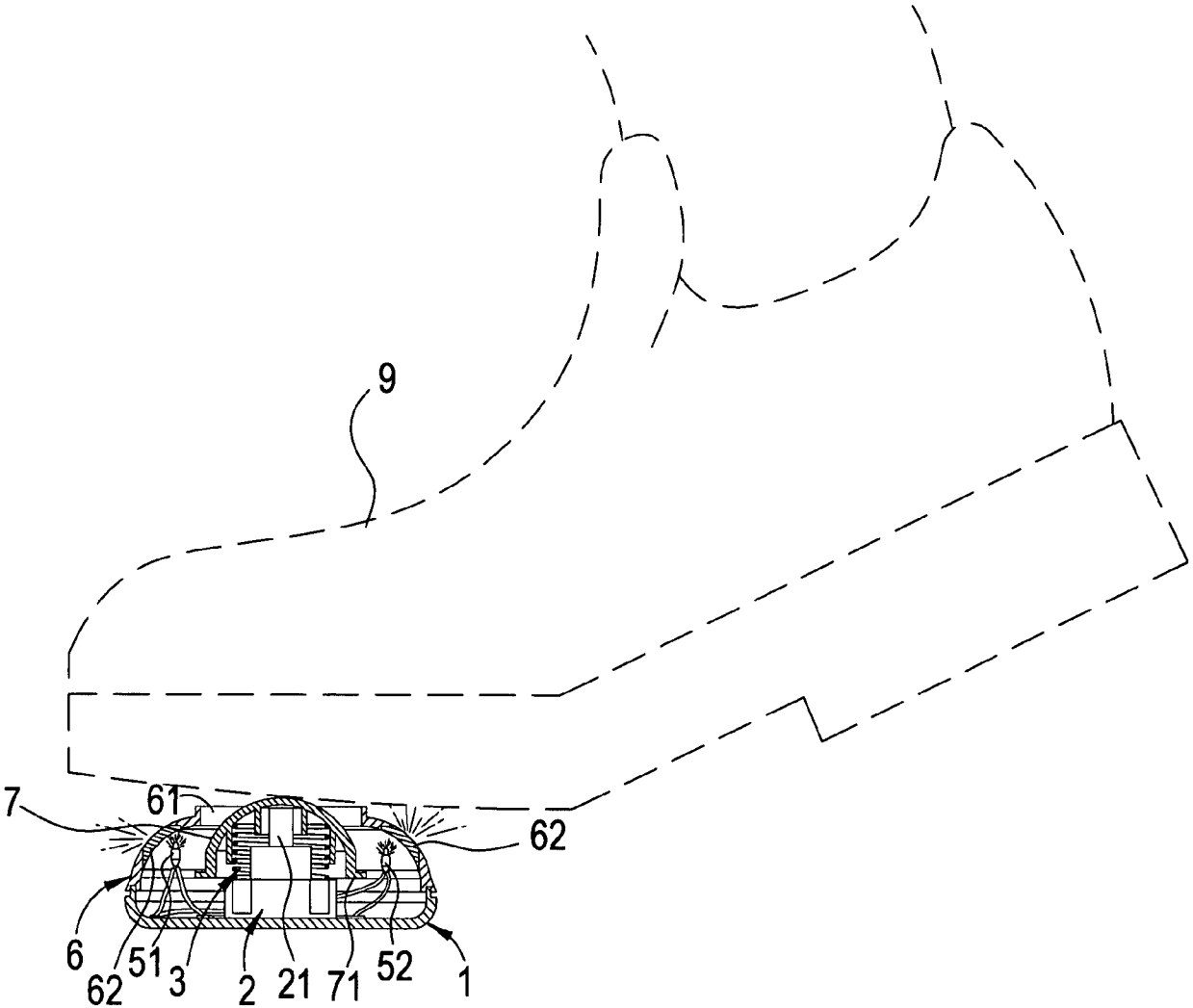
Figure 3C:
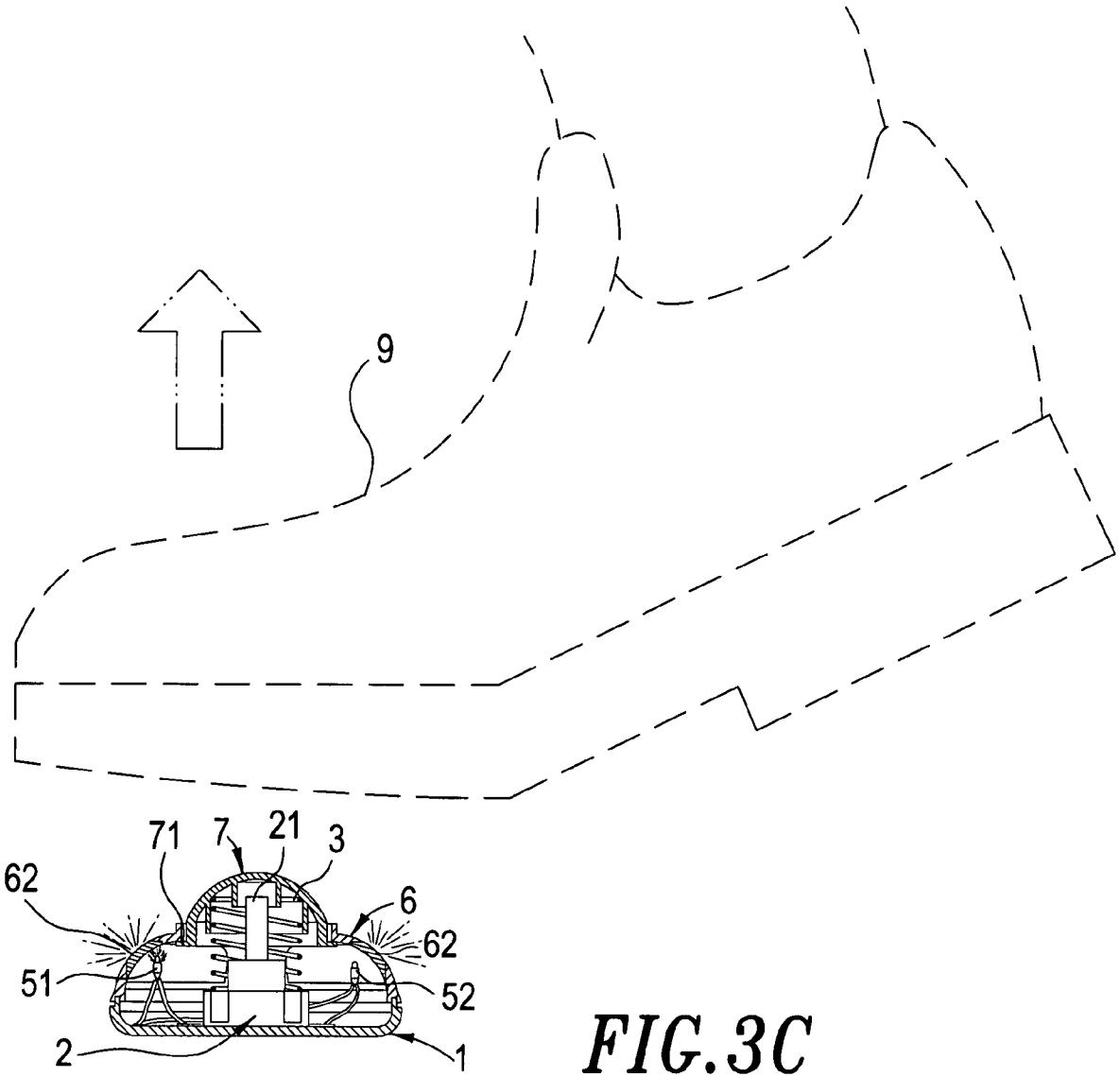

Referring to FIGS. 1 and 2, the improved foot switch structure of an extension cord receptacle provided by the invention comprises a base 1, an extension cord receptacle 4, a first and a second power indicator lamps 51 and 52, a top cover 6 and a button cover 7.

The base 1 is at least provided with a perforating hole 11 and an electrically conductive plate 12 fixed on an edge thereof. The front end of the electrically conductive plate 12 protrudes downward a tapering portion 121. In addition, a control switch 2 is fixed on the center of the base 1. The control switch 2 has two bilateral connecting terminals 22 and a protrudent control button 21 on the top surface thereof. The control button 21 is sheathed by a spring 3, wherein the spring 3 protrudes over the top portion of the control button 21.

The extension cord receptacle 4 comprises a power conducting wire 41. The power conducting wire 41 comprises a first conducting wire 411 and a second conducting wire 412 (one is a ground wire, and the other is an electricity conducting wire). One end of the power conducting wire 41 is connected to a power plug 42, and the other end thereof is connected to a power receptacle 43. The middle segment of the power conducting wire 41 is placed on the base 1, and the first conducting wire 411 (a ground wire or an electricity conducting wire) is bisected. The both bisectors are connected to the two bilateral connecting terminals 22 of the control switch 2, respectively. The second conducting wire 412 (a ground wire or an electricity conducting wire) is inserted by the tapering portion 121 of the electrically conductive plate 12 such that the tapering portion 121 contacts with the core of the second conducting wire 412 and thus the electrically conductive plate 12 is electrically connected with the second conducting wire 412. Meanwhile, the control switch 2 is located between the power plug 42 and the power receptacle 43. The power supplied from the power plug 42 will pass through first the control switch 2 and then the power receptacle 43, and thus the control switch 2 can control whether power is supplied to the power receptacle 43.

The first and second power indicator lamps 51 and 52 are connected to the electrically conductive plate 12 and the bilateral connecting terminals 22 of the control switch 2 such that the power indicator lamps 51 and 52 are disposed on opposite sides of the control switch 2. When the power conducting wire 41 is conducted, the first power indicator lamp 51 emits light continuously. Whereas, the second power indicator lamp 51 emits light when the control switch 2 is in the ON state.

The top cover 6 has a central opening 61. Each of the bilateral peripheries of the opening 61 is provided with a transparent window 62. The top cover is provided thereon with at least one bolt hole 63.

The button cover 7 has a cap rim 71 protruding from the periphery thereof. The button cover 7 is embedded in the opening 61 of the top cover 6 through the bottom end of the top cover 6, and the cap rim 71 protruded from the periphery of the button cover 7 is sustained against the inner wall surface of the top cover opening 61, such that the button cover 7 fails to penetrate through the top cover opening 61.

The base 1 is covered with the top cover 6 such that the locations of the bolt holes 63 on the top cover 6 correspond to the perforating hole 11 on the base 1. By using screws 8 to penetrate them, the top cover 6 is firmly secured to the base 1. The location of the button cover 7 secured to the center of the top cover 6 corresponds to the control button of the control switch 21. The spring 3 on the control switch 21 is sustained against the bottom surface of the button cover 7 such that the button cover 7 will not sag due to the support of the spring 3.

Please refer to FIGS. 2 and 3A, 3B and 3C, which are schematic views illustrating the actions of the present invention. When the power plug 42 of the extension cord receptacle 4 is plugged in the socket panel of the home's wall, power can be introduced to the control switch 2. Therefore, the first power indicator lamp 51 continuously emits light 53, which penetrates through the transparent window 62 of the top cover 6 so as to be used in the dark place and act as a night lamp. Meanwhile, the control switch 2 is still in the OFF state, and no power supplied to the power receptacle 43. When the user steps on the button cover 7 by his (her) foot 9, the button cover 7 is pressed down in response to the pressed force, and the control button 21 of the control switch 2 is transmitted to be pressed down. Therefore, the control switch 2 is in the ON state, and the spring 3 produces an elastic force, such that the second power indicator lamp 52 emits light 53, which also penetrates through the transparent window 62 of the top cover 6. Meanwhile, power can be introduced to the power receptacle 43 via the control switch 2 for use. Whereas, if no force is applied to the button cover 7, the button cover 7 is retuned to its original position in response to the elastic force of the spring 3. With the arrangement of the first and second power indicator lamps 51 and 52, the first power indicator lamp 51 can be used as an indicator showing no power introduced to the power receptacle 43 and to indicate the position of the control switch and act as a night lamp in the dark place, and the second power indicator lamp 52 can be used as an indicator showing the power-offering statuses of the power receptacle.

The improved foot switch structure of an extension cord receptacle provided by the present invention, when comparing with other previous conventional technologies, has following advantages:

1. The present invention provides two power indicator lamps in a foot switch, wherein one power indicator lamp continuously lamp emits light so as to indicate no power supplied to the power receptacle and the position of the control switch and act as a night lamp in the dark place; furthermore, when the two power indicator lamps simultaneously emit light, it is meant that the power receptacle is conducted for electric appliances to plug therein.

2. The present invention provides a foot switch on the extension cord receptacle such that the user can conduct or interrupt power by stepping on the foot switch or exerting force by foot so as to achieve safety.

3. According to the present invention, the tapering portion of the electrically conductive plate is inserted into one conducting wire of the power conducting wire, and thus the electrically conductive plate is electrically connected with the conducting wire; in addition, the two power indicator lamps can be directly welded onto the electrically conductive plate so as to achieve convenient connection.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An improved foot switch structure of an extension cord receptacle comprising:

a base having a control switch fixed thereon, said control switch having thereon a control button;

an extension cord receptacle comprising a power conducting wire, said power conducting wire having one end connected to a power plug, the other end connected to a power receptacle, and a middle segment placed on said base and electrically connected to said control switch, such that said control switch is located between said power plug and said power receptacle and controls whether power is conducted to said power receptacle;

a first and a second power indicator lamps connected to said power conducting wire and said control switch, respectively, such that said first and second power indicator lamps are disposed on opposite sides of said control switch, wherein said first power indicator lamp continuously emits light when said power conducting wire is conducted, and said second power indicator lamp emits light when said control switch is in an ON state so as to indicate that power is conducted to said power receptacle; and a top cover having embedded therein a button cover, said top cover being covered on said base such that the location of said button cover corresponds to said control button of said control switch, wherein said control switch is in said ON state when said control button is pressed down.

2. The improved foot switch structure of an extension cord receptacle according to claim 1, wherein said base has an electrically conductive plate fixed on an edge thereof, said electrically conductive plate having a tapering portion inserted into one conducting wire of said power conducting wire and electrically connected to said conducting wire, said first and second power indicator lamps being connected to said electrically conductive plate so as to achieve electric connection of said first and second power indicator lamps.

3. The improved foot switch structure of an extension cord receptacle according to claim 1, wherein said control button of said control switch is sheathed by a spring, the top portion of said spring being sustained against the bottom surface of said button cover, wherein said button cover is returned to the original position in response to an elastic force resulted when said button cover is pressed down.

4. The improved foot switch structure of an extension cord receptacle according to claim 1, wherein said top cover further comprises a central opening for embedding therein said button cover, said button cover having a cap rim protruding from the periphery thereof such that said button cover fails to penetrate through said opening of said top cover opening.

5. The improved foot switch structure of an extension cord receptacle according to claim 1, wherein each of the bilateral peripheries of said opening is provided with a transparent window for penetrating the light emitted from said first and second power indicator lamps.

6. The improved foot switch structure of an extension cord receptacle according to claim 5, wherein said base and said top cover are secured to each other by penetrating screws therethrough.

* * * * *